US005330869A

United States Patent [19]

Wilson et al.

[11] Patent Number: 5,330,869

[45] Date of Patent: Jul. 19, 1994

[54] ELECTROSTATOGRAPHIC TONER AND DEVELOPER COMPOSITIONS WITH PHTHALIMIDE DERIVATIVES

[75] Inventors: John C. Wilson, Rochester; Steven M. Bonser, Fairport; Hans W. Osterhoudt, Spencerport, all of N.Y.

[73] Assignee: Eastman Kodak Company, Rochester, N.Y.

[21] Appl. No.: 114,728

[22] Filed: Aug. 31, 1993

[51] Int. Cl.[5] ..... G03G 9/107; G03G 9/097

[52] U.S. Cl. ..... 430/106.6; 430/108; 430/110

[58] Field of Search ..... 430/106.6, 110

[56] References Cited

U.S. PATENT DOCUMENTS 4,585,734 4/1986 Weigel ..... 430/619

*Primary Examiner*—Roland Martin

*Attorney, Agent, or Firm*—Willard G. Montgomery

[57] ABSTRACT

This invention is directed to dry, negatively charged toner compositions and developer compositions which employ, as a charge-control agent, a compound selected from the group consisting of phthalimide, 4-aminophthalimide and 4-tert-butylphthalimide; as well as to methods of utilizing such compositions in electrostatographic imaging systems.

20 Claims, No Drawings

ELECTROSTATOGRAPHIC TONER AND DEVELOPER COMPOSITIONS WITH PHTHALIMIDE DERIVATIVES

FIELD OF THE INVENTION

This invention relates to electrostatography and, more particularly, to dry particulate electrostatic toners and developers.

BACKGROUND OF THE INVENTION

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer. If desired, the latent image can be transferred to another surface before development.

One well-known type of electrographic developer comprises a dry mixture of toner particles and carrier particles. Developers of this type are commonly employed in well-known electrographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the electrostatic latent image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited in the desired amount on the latent image-bearing surface. In order to meet these requirements for proper development, the level of electrostatic charge on the toner and carrier particles should be maintained within an adequate range.

Many known dry, two-component electrostatographic developers contain thermoplastic toner particles and carrier particles that comprise a core material which may or may not be coated with a polymer. Such polymeric carrier coatings can serve a number of known purposes. One such purpose can be to aid the developer to meet the electrostatic force requirements mentioned above by shifting the carrier particles to a position in the triboelectric series different from that of the uncoated carrier core material in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

Many different types of polymers have been described as useful for one or more of these purposes, among which are, for example, various styrene and methacrylate polymers and copolymers thereof. For example, U.S. Pat. Nos. 4,209,550; 4,572,885; and 4,822,708, and British published Patent Specification 1,385,231, suggest that, among many other polymers, poly(styrene), poly(methyl methacrylate), and poly(styrene-co-methyl methacrylate) may serve one or more of these purposes.

However, while such carrier coatings can serve the above-noted purposes well, in some cases they do not adequately serve some or all of these purposes simultaneously. For example, in some developer compositions, styrene and methacrylate polymer carrier coatings can serve many of the above-noted purposes well, but, depending upon the nature of the toner particles, such carrier coatings can cause the toner to acquire a triboelectric charge that is too low for optimum developer performance. This is true in some negatively charged developers (developers in which the toner particles triboelectrically acquire a negative charge, and the coated carrier particles acquire a positive charge). This is particularly true in such developers where the carrier coating material comprises poly(methyl methacrylate) or a copolymer of p-t-butylstyrene and a $C_1$–$C_4$ alkyl methacrylate and the toner particles comprise a polymeric binder which is a polyester having a glass transition temperature of approximately 500° to 100° C. and a weight average molecular weight of approximately 20,000 to 100,000. Such polyester toner binders are very useful and are widely used in producing electrophotographic color images because of their ability to minimize offset which occurs when some of the toner adheres to the paper, while some remains on the fusing roller and then bonds to the next piece of paper. The low toner charge is due to the fact that these polymeric carrier coating materials are not triboelectrically potent or efficient enough to achieve the desired degree of charging. Consequently, the toner particles are undercharged resulting in less than optimum developer performance and hence less than optimum image development and image quality.

Thus, there remains a need to establish and maintain a proper level of charge on the toner particles described above so that the desired level of charge on the toner particles required for optimum image development and image quality can be achieved. The present invention meets that need.

SUMMARY OF THE INVENTION

The present invention provides improved dry, electrostatic toner and developer compositions which employ, as a charge-control agent, phthalimide, 4-aminophthalimide or 4-tert-butylphthalimide. In addition to solving the problems created by the carrier-coating materials described above, it has been found that electrostatographic developer compositions which employ these materials as a charge-control agent exhibit low dusting characteristics. Dusting (also referred to as throw-off) is defined as the amount of toner and any other particulate matter that is thrown out of the developer (i.e., that is not adequately held to the surfaces of the carrier particles) during agitation of the developer, e.g., by a typical development apparatus such as a magnetic roll applicator. High levels of dusting can cause undesirable effects such as excessive wear and damage of electrostatographic imaging apparatus, contamination of environmental air with toner powder and other particulate matter, unwanted development of background image areas, and scumming of the surface of photoconductive elements that leads to poorer electrophotographic performance and shorter useful life.

The improved toner compositions of the present invention comprise finely-divided fusible particles of a binder polymer having dispersed, or otherwise distributed in the binder polymer as a charge-control agent, a minor amount of a compound selected from the group consisting of phthalimide, 4-aminophthalimide or 4-tert-butylphthalimide.

Advantageously, a colorant such as a pigment or dye also can be dispersed or otherwise distributed in the binder polymer of the toner. The polymeric binder comprises a polyester having a glass transition temperature of 50° to 100° C. and a weight average molecular weight of 20,000 to 100,000.

Dry electrographic developers of this invention comprise a mixture of the inventive toner particles defined above and carrier particles comprising a core particle having a polymeric overcoat of a polymer comprising poly(methyl methacrylate) or a copolymer of p-t-butylstyrene and a $C_1$–$C_4$ alkyl methacrylate.

As a consequence of incorporating the charge-control agents of the invention into the toner polymer, the triboelectric charging characteristics of the toner are changed so as to enable the toner particles described above to be charged to a higher, more acceptable charge range suitable for obtaining optimum image development and image quality. In addition, the toner particles containing the charge-control agents described herein exhibit a uniform, stable electrical charge. That is, all or substantially all, of the individual discrete toner particles exhibit a triboelectric charge of the same sign which is maintained at a specified, optimum level of charge or range of charge necessary for achieving optimum image development and image quality. Still further, the inventive electrographic developers of the invention do not exhibit unacceptably high levels of dusting during developer use.

Thus, in one embodiment of the present invention there is provided a new electrostatographic toner composition which comprises dry, finely-divided fusible particles of a binder polymer wherein the binder polymer comprises a polyester having a glass transition temperature of 500° to 100° C. and a weight average molecular weight of 20,000 to 100,000 and, dispersed or otherwise distributed in the binder polymer as a charge-control agent, a minor amount of a compound selected from the group consisting of phthalimide, 4-aminophthalimide and 4-tert-butylphthalimide.

In another embodiment or aspect of the present invention, there is provided a new electrostatographic developer composition which comprises a mix of carrier particles and toner particles wherein each of the carrier particles comprises a core particle having a polymeric overcoat of a polymer comprising poly(methyl methacrylate) or a copolymer of p-t-butylstyrene and a $C_1$–$C_4$ alkyl methacrylate and each of the toner particles comprises dry, finely-divided fusible particles of a binder polymer wherein the binder polymer comprises a polyester having a glass transition temperature of 50° to 100° C. and a weight average molecular weight of 20,000 to 100,000 and dispersed, or otherwise distributed in the Dinder polymer as a charge-control agent, a minor amount of a compound selected from the group consisting of phthalimide, 4-aminophthalimide and 4-tert-butylphthalimide.

DETAILED DESCRIPTION OF THE INVENTION

As mentioned previously, the charge-control agents or additives employed in the toners and developers of the present invention constitute a compound selected from the group consisting of phthalimide, 4-aminophthalimide or 4-tert-butylphthalimide. Both phthalimide and 4-aminophthalimide can be purchased commercially from Eastman Fine Chemicals, Eastman Chemical Company, 343 State Street, Rochester, N.Y. and 4-tert-butylphthalimide can readily be prepared by several known methods such as, for example, by reacting 4-tert-butylphthalic acid anhydride with urea at elevated temperature to form a melt, cooling the melt and dissolving it in DMF and then adding water to precipitate out 4-t-butylphthalimide. See McClelland, R. A.; Seaman, N. E.; Duff, J. M.; and Branston, R. E. "Kinetics and Equilibrium in the Ammonolysis of Substituted Phthalimides" Can. J. Chem., Vol 63, (1985) p. 121.

To be utilized as a charge-control agent in the electrostatic toners of the invention, the charge-control agents of the invention are mixed in any convenient manner (preferably by melt-blending as described, for example, in U.S. Pat. Nos. 4,684,596 and 4,394,430) with an appropriate polymeric toner binder material and any other desired toner addenda and the mix is then ground to desired size to form a free-flowing powder of toner particles containing the charge agent. Conventional particle classification techniques can be used to achieve a toner particle composition having a desired particle size and particle distribution. The toner compositions of the present invention also can be prepared by a number of other methods well known in the art such as spray drying, melt dispersion, dispersion polymerization and suspension polymerization. The resulting electrostatographic toner powder comprises particles of a toner polymer having dispersed or otherwise distributed within each particle a charge-control agent of the present invention and other desired toner addenda.

The average particle size of the powdered toner can be in the range of from about 0.1 to 100 micrometers, a range of from about 1 to 30 micrometers being preferred for many of the office copying machines currently being used. However, larger or smaller particles may be needed for particular methods of development or development conditions. The term "particle size" as used herein, or the term "size" as employed herein in reference to the term "particles", means volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by the total particle mass.

The charge-control agent is added to the toner in an amount effective or sufficient to improve the charging properties of the toner compositions so as to enable the toner particles to acquire a level of charge appropriate or suitable for obtaining optimum image development and image quality. Generally, it is desirable to add from about 0.05 to about 6 parts and preferably 0.05 to about 2.0 parts by weight of the aforementioned charge-control agents per 100 parts by weight of polymer to obtain the improved toner compositions of the present invention. Although larger or smaller amounts of charge-control agent can be added, if much lower amounts are used, the charge-control agent provides little or no effect and if much higher amounts are used, the charge on the toner becomes unstable and the toner can acquire a triboelectric charge that is outside the range for optimum image development. Of course, it must be recognized that the optimum amount of charge-control agent to be added will depend, in part, on the particular polymer to which it is added. However, the amounts specified hereinabove are typical of the useful range of charge-control agent utilized in the dry toner materials.

Binder polymers or resins which are used with the charge-control additives of the present invention are polyesters having a glass transition temperature of 50° to 100° C. and a weight average molecular weight of 20,000 to 100,000. The polyesters can be prepared from the reaction product of a wide variety of diols and dicarboxylic acids known to be useful in preparing polyester binders for toner particles.

Some specific examples of suitable diols are: 1,4-cyclohexanediol; 1,4-cyclohexanedimethanol; 1,4-cyclohexanediethanol; 1,4-bis(2-hydroxyethoxy) cyclohexane; 1,4-benzenedimethanol; 1,4-benzenediethanol; norbornylene glycol; decahydro-2,6-naphthalenedimethanol; bisphenol A; ethylene glycol; diethylene glycol; triethylene glycol; 1,2-propanediol, 1,3-propanediol; 1,4-butanediol; 2,3-butanediol; 1,5-pentanediol; neopentyl glycol; 1,6-hexanediol; 1,7-heptanediol; 1,8-octanediol; 1,9-nonanediol; 1,10-decanediol; 1,12-dodecanediol; 2,2,4-trimethyl-1,6-hexanediol; and 4-oxa-2,6-heptanediol.

Suitable dicarboxylic acids include: succinic acid; sebacic acid; 2-methyladipic acid; diglycolic acid; thiodiglycolic acid; fumaric acid; adipic acid; glutaric acid; cyclohexane-1,3-dicarboxylic acid; cyclohexane-1,4-dicarboxylic acid; cyclopentane-1,3-dicarboxylic acid; 2,5-norbornanedicarboxylic acid; phthalic acid; isophthalic acid; terephthalic acid; 5-butylisophthalic acid; 2,6-naphthalenedicarboxylic acid; 1,4-naphthalenedicarboxylic acid; 1,5-naphthalenedicarboxylic acid; 4,4'-sulfonyldibenzoic acid; 4,4'-oxydibenzoic acid; binaphthyldicarboxylic acid; and lower alkyl esters of the acids mentioned.

Polyfunctional compounds having three or more carboxyl groups, and three or more hydroxyl groups are desirably employed to create branching in the polyester chain. Triols, tetraols, tricarboxylic acids, and functional equivalents, such as pentaerythritol, 1,3,5-trihydroxypentane, 1,5-dihydroxy-3-ethyl-3-(2-hydroxyethyl)pentane, trimethylolpropane, trimellitic anhydride, pyromellitic dianhydride, and the like are suitable branching agents. Presently preferred polyols are glycerol and trimethylolpropane. Preferably, up to about 15 mole percent, preferably 5 mole percent, of the reactant diol/polyol or diacid/polyacid monomers for producing the polyesters can be comprised of at least one polyol having a functionality greater than two or polyacid having a functionality greater than two.

Variations in the relative amounts of each of the respective monomer reactants are possible for optimizing the physical properties of the polymer.

The polyesters of this invention are conveniently prepared by any of the known polycondensation techniques, e.g., solution polycondensation or catalyzed melt-phase polycondensation, for example, by the transesterification of dimethyl terephthalate, dimethyl glutarate, 1,2-propanediol and glycerol.

The polyesters also can be prepared by two-stage polyesterification procedures, such as those described in U.S. Pat. No. 4,140,644 and U.S. Pat. No. 4,217,400. The latter patent is particularly relevant, because it is directed to the control of branching in polyesterification. In such processes, the reactant glycols and dicarboxylic acids, are heated with a polyfunctional compound, such as a triol or tricarboxylic acid, and an esterification catalyst in an inert atmosphere at temperatures of 190° to 280° C., preferably 200° to 260° C. Subsequently, a vacuum is applied, while the reaction mixture temperature is maintained at 220° to 240° C., to increase the product's molecular weight.

The degree of polyesterification can be monitored by measuring the inherent viscosity of samples periodically taken from the reaction mixture. The reaction conditions used to prepare the high molecular weight polyesters should be selected to achieve an I.V. of 0.10 to 0.80 measured in methylene chloride solution at a concentration of 0.25 grams of polymer per 100 milliliters of solution at 25° C. An I.V. of 0.10 to 0.60 is particularly desirable to insure that the polyester has a weight average molecular weight of 20,000 to 100,000, preferably 55,000 to 65,000, a branched structure, a fusing temperature in the range of about 65° to about 200° C., and a $T_g$ in the range of about 50° to about 100° C. Preferred are resins which fuse in the range of about 65° to 120° C. Amorphous polyesters are particularly well suited for use in the present invention. After reaching the desired inherent viscosity, the polyester is isolated and cooled.

One presently preferred class of polyesters comprises residues derived from the polyesterification of a polymerizable monomer composition comprising:

a dicarboxylic acid-derived component comprising:
about 75 to 100 mole % of dimethyl terephthalate and
about 0 to 25 mole % of dimethyl glutarate and
a diol/polyol-derived component comprising:
about 90 to 100 mole % of 1,2-propane diol and
about 0 to 10 mole % of glycerol.

Many of the aforedescribed polyesters are disclosed in the patent to Alexandrovich et al., U.S. Pat. No. 5,156,937.

As mentioned previously, polyesters useful in the present invention generally have a glass transition temperature of from about 500 to about 100° C. and an I.V. of 0.10 to 0.8 measured in methylene chloride solution at a concentration of 0.25 grams of polymer per 100 milliliters of solution at 25° C. The term "glass transition temperature" or "$T_g$" as unused herein means the temperature at which a polymer changes from a glassy state to a rubbery state. This temperature ($T_g$) can be measured by differential thermal analysis as disclosed in "Techniques and Methods of Polymer Evaluation" Vol 1 Marcel Dekker, Inc , N.Y , 1966 The term "inherent viscosity" or "I.V." as used herein means the logarithmic viscosity number defined in "Properties of Polymers" by D. W. Van Krevelan, Elsevier, North Holland, Inc. 1972. Preferably, toner particles prepared from these polymers have a relatively high caking temperature, for example, higher than about 50° C., so that the toner powders can be stored for relatively long periods of time at fairly high temperatures without having individual particles agglomerate and clump together.

Toner particles prepared from these polymers can have fusing temperatures in the range of from about 100° C. to 250° C. so they can readily be fused to paper receiving sheets. Preferred toners fuse in the range of from about 150° C. to 200° C. If the toner transfer is made to receiving sheets which can withstand higher temperatures, toner particles of higher fusing temperatures can be used.

Various kinds of well-known addenda (e.g., colorants, release agents, such as conventionally used polysiloxanes or waxes, etc.) also can be incorporated into the toners of the invention.

Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2, Second Edition.

Included among the vast number of useful colorants are those dyes and/or pigments that are typically employed as blue, green, red, yellow, magenta and cyan colorants used in electrostatographic toners to make color copies. Examples of useful colorants are Hansa Yellow G (C.I. 11680), Nigrosine Spirit soluble (C.I. 50415), Chromogen Black ETOO (C.I. 45170), Solvent Black 3 (C.I. 26150), Hostaperm Pink E-02 (Hoechst-Celanese), Fuchsine N (C.I. 42510), C.I. Basic Blue 9 (C.I. 52015) and Pigment Blue 15:3 (C.I. 74160). Carbon black also provides a useful colorant. The amount of colorant added may vary over a wide range, for example, from about 1 to about 20 percent of the weight of the polymer. Particularly good results are obtained when the amount is from about 1 to about 10 weight percent.

To be utilized as toners in the electrostatographic developers of the invention, the toners of this invention can be mixed with a carrier vehicle. The carrier vehicles which can be used with the present toners to form the new developer compositions comprise a core material which is overcoated with a thin layer of a film-forming polymer comprising poly(methyl methacrylate) or a copolymer of p-t-butylstyrene and a $C_1$–$C_4$ alkyl methacrylate methyl methacrylate or isobutyl methacrylate).

Any of the core materials generally known to be useful in carrier particles for electrographic developers can be used to form the carriers of the present invention. The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,662 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As described above, the polymer coated on the carrier core particles comprises poly(methyl methacrylate) or a copolymer of p-t-butylstyrene and a $C_1$–$C_4$ alkyl methacrylate such as methyl methacrylate or isobutyl methacrylate. Typically, when a copolymer of p-t-butylstyrene and methyl methacrylate is used as the coating material, a weight ratio of methyl methacrylate to p-t-butylstyrene of 75 to 25 or 95 to 5 is employed.

Methods of coating a polymer onto carrier core particles in a continuous or discontinuous configuration of various uniform or non-uniform thicknesses are well known. Some useful coating methods include solution-coating, spray application, plating, tumbling, shaking, fluidized bed coating, and melt-coating. Any such methods can be employed to prepare the coated carrier particles useful for the present invention. See, for example, U.S. Pat. Nos. 4,546,060; 4,478,925; 4,233,387; 4,209,550; and 3,507,686.

In coating polymers useful for the present invention, relative amounts of the polymer can be varied to achieve the desired properties. Optimum amounts will depend on the nature of all materials involved (including the nature of toner particles with which the carrier particles are intended to be subsequently mixed in order to form a developer) and the amount of charge per unit mass desired, but, for example, in the specific case of strontium ferrite core particles having average particle diameters in the range of about 30 to 40 micrometers, the coating will usually comprise, by weight, 3 pph coating material (parts per hundred parts core material) or less, if melt-coating is employed (because higher proportions of coating material may make it very difficult to properly break apart the solidified mass to yield the discrete coated carrier particles) and about 2 pph coating material or less, if solution-coating is employed (because higher proportions of coating material can cause particle agglomeration while driving off the solvent, with consequent incompleteness and/or non-uniformity of the coating). These preferable upper limits of weight ratios of coating material to core material will vary as surface area-to-mass ratio of the core particles varies; i.e., the preferable upper limits will be higher when surface area-to-mass is higher than in the specific case noted and will be lower when surface area-to-mass is lower than in the specific case noted.

The resultant carrier particles can be spherical or irregular in shape, can have smooth or rough surfaces, and can be of any size known to be useful in developers. Conventional carrier particles usually have an average particle diameter in the range of about 1 to about 1200 micrometers, preferably 1-300 micrometers.

A typical developer composition of the invention containing the above-described toner and a carrier vehicle comprises from about 1 to 20 percent, by weight, of particulate toner particles and from about 80 to about 99 percent, by weight, carrier particles.

The toner and developer compositions of the invention are referred to as electrostatographic compositions. This means that they are not limited to use in electrophotographic processes but can develop images in processes not requiring the use of light sensitive materials, e.g., as in dielectric recording. They are especially useful, however, for developing charge patterns on photoconductive surfaces. The photoconductive surfaces can be of any type, e.g., inorganic photoconductors such as selenium drums and paper coated with a zinc oxide composition or organic photoconductors such as disclosed in the patents to Light, U.S. Pat. Nos. 3,615,414 and Berwick et al., 4,175,960. Thus, in another embodiment of the present invention there is provided a method of developing electrostatic latent images which method comprises contacting the latent image with the toner composition of the present invention, followed by transferring the resultant image to a suitable substrate and, optionally, permanently affixing the image by, for example, heat.

Although the dry developer compositions of the invention are useful in all methods of dry development, including magnetic brush development, cascade development and powder cloud development, they are especially suitable for use in the magnetic brush method which, as mentioned previously, employs a so-called two-component developer. This is a physical mixture of magnetic carrier particles and of finely divided toner particles.

A particularly preferred developer composition of the present invention comprises, as the carrier component thereof, magnetic particles of a core material of strontium ferrite coated with a thin layer of a resin consisting of a copolymer of methyl methacrylate and p-t-butylstyrene in a weight ratio of 95 to 5 and, as the toner component thereof, fusible particles formulated from 100 parts of a binder polymer comprising a polyester of the present invention which is a condensation polymer made from dimethyl terephthalate, dimethyl glutarate, 1,2-propanediol and glycerol (mole ratio 87.0:13.0:92.5:5.0), a Tg of 64° C. and an I.V. of 0.43 as measured herein, containing, as a charge-control agent, 4-tert-butylphthalimide. The toner particles triboelectrically acquire a negative charge during mixing, while the carrier particles acquire a positive charge.

As mentioned previously, incorporation of the charge-control agents of the present invention into a polymeric toner composition of the type described herein improves the charge uniformity of the toner composition, i.e., provides a toner composition in which all, or substantially all, of the individual discrete toner particles exhibit a triboelectric charge of the same sign, maintains a stable electrical charge at a specified optimum level or range on the toner particles during the process of continuous development and replenishment, and minimizes the amount of "toner throw-off" of a given developer composition.

The following examples provide a further understanding of the invention.

EXAMPLE 1

Toners and Developers

An inventive magenta pigmented toner composition of the present invention was formulated from 96 parts by weight of a toner binder comprising a polyester which was a condensation polymer made from dimethyl terephthalate, dimethyl glutarate, 1,2-propane diol and glycerol (mole ratio 87.0:13.0:92.5:5.0); 4 parts by weight of a release agent consisting of a low surface adhesion block copolymer composed of azelaoyl chloride and bisphenol A joined to a block of aminopropyl-terminated poly(dimethylsiloxane); 2 parts by weight 4-tert-butylphthalimide as a charge-control agent and 5 parts by weight of a colorant Hostaperm Pink E-02 (Hoechst-Celanese). The formulation was melt-blended on a two-roll mill for 20 minutes at 130° C., allowed to cool to room temperature and then pulverized on a Wiley-Mill TM (a brand of pulverizer marketed by Arthur H. Thomas Company, Philadelphia, Pa.) to form non-classified inventive toner particles having a volume average particle size in the range of from about 9 to 11 micrometers. The polyester was prepared according to the following procedure:

Polymer Preparation

A mixture of 422.4 g (2.175 mol) of dimethyl terephthalate; 52.1 g (0.325 mol) of dimethyl glutarate; 252.1 g (3.3125 mmol) of 1,2-propanediol; 11.5 g (0.125 mol) glycerol and a catalytic amount (25 drops) of titanium tetraisopropoxide was heated in a 1L polymer flask equipped with a Vigreaux-Claisen head, nitrogen inlet and sealed side arm according to the following schedule:

2 hrs at 220° C;

1 hr at 240° C; and 1 hr at 240° C. with the head removed.

A metal blade stirrer was then introduced and the mixture was stirred at 240° C. for 1.0 hr at 0.60 mm pressure. The polymer which resulted was then cooled and isolated.

IV (DCM)=0.43

$T_g$=64° C.

The 4-tert-butylphthalimide charge-control agent was synthesized according to the following procedure.

4-t-butylphthalimide Preparation

A mixture of 25.0 g (0.1224 mol) of 4-tert-butylphthalic anhydride and 3.68 g (0.0612 mol) of urea was heated in a 130° C. bath for 70 minutes and cooled. The solid cake was treated with hot water, cooled, filtered using a fritted glass filter funnel, washed with water and dried. The material was then dissolved in 150 ml of hot 1:1 heptane: toluene, filtered using a fritted glass filter funnel and the filtrate cooled. The solid which crystallized was collected, washed with ligroine and dried. This solid was dissolved in 50 ml of DMF and 150 ml of water was added dropwise with stirring thereby precipitating a white solid. The solid was collected, washed with water and dried to give 9.0 g of product (36.18% of theory); mp=134°-7° C. (rep mp=136°-8° C.).

Anal. Calcd. for $C_{12}H_{13}NO_2$: C, 70.92; H, 6.45; N, 6.89;

Found: C, 70.85; H, 6.45; N, 6.84

An inventive developer was prepared by mixing the toner particles prepared as described above (at a weight concentration of 12% toner) with carrier particles comprising strontium ferrite cores thinly coated (approximately 2 percent by weight) with a copolymer of methyl methacrylate and p-t-butylstyrene (weight ratio: 95/5). The volume average particle size of the carrier particles was from about 25 to 35 micrometers. Toner charge was then measured in microcoulombs per gram of toner (μc/G) in a "MECCA" device for the inventive toner formulated as described above. The optimum level of charge for achieving optimum developer performance and hence optimum image development and image quality for the inventive toner, formulated as described above, is from about −20 to −60 microcoulombs per gram of toner, preferably from about −30 to −50 microcoulombs per gram of toner. Prior to measuring the toner charge, the developer was vigorously shaken or "exercised" to cause triboelectric charging by placing a 4 gram sample of the developer (3.52 grams of carrier and 0.48 gram of toner) into a glass vial, capping the vial and shaking the vial on a "wrist-action" shaker operated at about 2 Hertz and an overall amplitude of about 11 cm for 2 minutes. Toner charge level after 2 minutes of exercising was measured by placing a 100 milligram sample of the charged developer in a MECCA apparatus and measuring the charge and mass of transferred toner in the MECCA apparatus. This involves placing the 100 milligram sample of the charged developer in a sample dish situated between electrode plates and subjecting it, simultaneously for 30 seconds, to a 60 Hz magnetic field to cause developer agitation and to an electric field of about 2000 volts/cm between the plates. The toner is released from the carrier and is attracted to and collects on the plate having polarity opposite to the toner charge. The total toner charge is measured by an electrometer connected to the plate, and that value is divided by the weight of the toner on the plate to yield the charge per mass of toner in microcoulombs per gram (μc/g).

The toner charge level (i.e., charge-to-mass ratio) also was taken after exercising the developer for an additional 10 minutes by placing the magnetized developer in a glass bottle on top of a typical device designed to form a developer into an agitating magnetic brush for development of electrostatic images into toner images (in this case, a cylindrical roll with rotating magnetic core rotating at 2000 revolutions per minute to closely approximate typical actual use of the developer in an electrostatographic development process). The procedure for measuring the toner charge in microcoulombs per gram with the MECCA apparatus was the same as described above. It should be noted that the microcoulomb per gram values reported below after 10 minutes of exercising are in fact microcoulomb per gram values after the 2 minute shake and 10 minutes on the bottle brush, i.e., after a total of 12 minutes of exercising.

After 2 minutes of shaking, the toner had a charge of −40.0 microcoulombs/gram and after 12 minutes of exercising the toner had a charge of −34.3 microcoulombs/gram. This is well within the desired optimum range of charging for the toner composition to achieve optimum image development and image quality. A control developer in which the toner component thereof did not contain the 4-tert-butylphthalimide charge-control agent was prepared for comparative purposes using the same carrier particles in the same proportions as were used in the inventive developer composition described above. Thus, there was prepared a magenta pigment toner composition formulated from 96 parts by weight of a toner binder comprising a polyester prepared according to the procedure described above, 4 parts by weight of the same release agent described above and 5 parts by weight of the same colorant utilized in the inventive toner composition described above. The formulation was melt-blended on a two-roll mill for 20 minutes at 130° C., cooled to room temperature and pulverized on a Wiley-Mill TM to form non-inventive toner particles having a volume average particle size in the range of about 9 to 11 micrometers. The charge on the toner after 2 minutes of shaking was −34.2 microcoulombs/gram. However, after 10 minutes of exercising the toner on the bottle brush it had dropped to -19.7 microcoulombs/gram. This is below the optimum charging level for the toner composition. As evidenced by these results, the charge-control agent of the present invention was able to establish and maintain the charge to mass ratio at a level for optimum developer performance and hence optimum image development and image quality. In contrast, tribocharging in the control toner fell below the optimum range for optimum developer performance after 10 minutes of exercising on the bottle brush.

EXAMPLE 2

Toner charge measurements for the inventive developer composition described in Example 1 in which 2 parts by weight of phthalimide was substituted as a charge-control agent for the 4-tert-butylphthalimide charge-control agent used in Example 1 showed that after 2 minutes of shaking, the toner had a charge of −41.8 microcoulombs per gram of toner and after 12 minutes of exercising, it had a charge of −34.1 microcoulombs per gram of toner. These values are within the range for optimum image development.

EXAMPLE 3

Toner charge measurements for the inventive developer composition described in Example 1 in which 2 parts by weight of 4-aminophthalimide was substituted for the 4-tert-butylphthalimide charge-control agent used in Example 1 showed that after 2 minutes of exercising the toner had a charge of −21.0 microcoulombs per gram of toner and after 12 minutes of exercising it had a charge of −27.8 microcoulombs per gram of toner. These values are within the range for optimum image development.

EXAMPLE 4

This example illustrates that the developers of this invention exhibit a low degree of dusting (toner throw-off). Toner throw-off measurement for the inventive developer composition described in Example 1 was determined by mixing the same inventive toner particles as described in Example 1 above with carrier particles of the same type as described in Example 1 to form a charged developer comprising approximately 12% toner by weight (approximately 3.52 grams of carrier and 480 milligrams of toner); agitating the developer for 2 minutes on a "wrist-action" shaker followed by exercising the developer for 10 minutes on a bottle brush as described in Example 1; mixing more (approximately 240 milligrams)of the same type of fresh inventive toner particles into the developer to form a charged developer comprising about 17% toner by weight (approximately 3.52 grams of carrier and 72% milligrams of toner); shaking the developer on a "wrist-action" shaker for 2 minutes as described above; placing the developer in an open container held in place on top of the bottle brush device described above; placing a funnel, containing a weighed piece of fiberglass filter paper and a vacuum hose connected to its spout, in an inverted position securely over the open container spaced approximately 5 cm from the container; simultaneously for one minute, rotating the magnetic core of the brush at 500 revolutions per minute to form an agitating magnetic developer brush as in a normal development process and applying vacuum (approximately 361 torr) to the funnel to collect on the filter paper any material thrown off of the agitating magnetic developer brush; weighing the filter paper and collected material; and then subtracting the weight of the filter paper alone from this combined weight to determine the degree of dusting in milligrams (mg). Previous experience has shown that under these test conditions, good developer formulations lose at most 10 milligrams of toner (i.e., less than 1.4 weight percent of the toner actually present). The amount of toner throw-off for the inventive developer of Example 1 was only 2.5 milligrams of toner which is a very low amount of throw-off. Toner throw-off for the control developer described in Example 1 also was determined in the same manner as described above for the inventive developer and found to be 4.6 milligrams of toner.

Toner throw-off measurements for the inventive developer compositions of Examples 2 and 3 also were determined according to the procedure described in Example 4, above. The amount of toner throw-off for the inventive developer composition of Example 2 was only 1.5 milligrams of toner and that of the inventive developer composition of Example 3 was only 2.2 milligrams of toner.

Thus, the addition of the charge-control agent employed in the present invention improves the charge uniformity of the toner composition, i.e., provides a toner composition in which all or substantially all of the individual discrete toner particles exhibit a triboelectric charge of the same sign, maintains a stable electrical charge on the toner particles at a specified optimum level or range of charge and reduces toner throw-off.

Although the invention has been described in considerable detail with particular reference to certain preferred embodiments thereof, variations and modifications can be effected within the spirit and scope of the invention.

What is claimed is:

1. Fusible, dry electrostatographic toner particles comprising a binder polymer and a charge-control agent wherein the binder polymer comprises a polyester having a glass transition temperature of 500 to 100° C. and a weight average molecular weight of 20,000 to 100,000 and the charge-control agent is a compound selected from the group consisting of phthalimide, 4-aminophthalimide and 4-tert-butylphthalimide.

2. Toner particles according to claim 1, wherein the polyester has a glass transition temperature of 50° to 96° C. and is derived from the polyesterification of a polymerizable monomer composition comprising:

a dicarboxylic acid-derived component comprising:

75 to 100 mole percent of dimethyl terephthalate and 0 to 25 mole percent of dimethyl glutarate and a diol/polyol-derived component comprising:

90 to 100 mole percent of 1,2-propane diol and 0 to 10 mole percent of glycerol.

3. Toner particles according to claim 1, wherein the polyester contains a branching agent.

4. Toner particles according to claim 1, wherein the polyester has a glass transition temperature of about 64° C.

5. Toner particles according to claim 1, wherein the particles are spherical particles.

6. Toner particles according to claim 1, wherein the particles are irregular, pulverized particles.

7. Toner particles according to claim 1 having an average particle size of from about 0.1 to micrometers.

8. Toner particles according to claim 1 further containing a colorant.

9. Toner particles according to claim 1, wherein the concentration of the charge-control agent is from about 0.05 to 6.0 parts by weight of charge-control agent per 100 parts by weight binder polymer.

10. A dry, electrostatographic developer composition comprised of a mix of carrier particles and toner particles wherein the toner particles are comprised of a binder polymer and a charge-control agent wherein the binder polymer comprises a polyester having a glass transition temperature of 50° to 100° C. and a weight average molecular weight of 20,000 to 100,000 and the charge-control agent is a compound selected from the group consisting of phthalimide, 4-aminophthalimide and 4-tert-butylphthalimide and wherein each of the carrier particles comprises a core particle having an overcoat of a polymer comprising poly(methyl methacrylate) or a copolymer of butylstyrene and a $C_1$–$C_4$ alkyl methacrylate.

11. A developer composition of claim 10, wherein the core particle comprises a metallic material.

12. A developer composition according to claim 11, wherein the metallic metal is ferromagnetic.

13. A developer composition according to claim 12, wherein the metallic material comprises a strontium ferrite material.

14. A developer composition according to claim 13, wherein the core particles are magnetic.

15. A developer composition according to claim 10, wherein the mix of toner particles and carrier particles comprises from about 80 to 99 percent by weight of finely divided carrier particles and from about 1 to 20 percent by weight of finely divided toner particles.

16. A developer composition according to claim 10, wherein the toner particles in the developer are negatively charged,

17. A developer composition according to claim 16, wherein the charge of the developer is from −20 to −60 microcoulombs per gram of toner in the developer.

18. A developer composition according to claim 10, wherein the carrier particles comprise magnetic particles of a core material of strontium ferrite coated with a thin layer of a resin comprising a copolymer of methyl methacrylate (95 weight percent) and p-t-butylstyrene (5 weight percent) and the toner particles comprise a binder polymer comprising a polyester having a glass transition temperature of 50° to 96° C. derived from the polyesterification of a polymerizable monomer composition comprising:

a dicarboxylic acid-derived component comprising:

75 to 100 mole percent of dimethyl terephthalate and 0 to 25 mole percent of dimethyl glutarate and a diol/polyol-derived component comprising:

90 to 100 mole percent of 1,2-propane diol and 0 to 10 mole percent of glycerol.

19. A developer composition according to claim 10, wherein the concentration of the charge-control agent is from about 0.5 to 6.0 parts by weight of charge-control agent per 100 parts by weight binder polymer.

20. A method of developing an electrostatic latent image which comprises forming an electrostatic latent image on an insulative surface of an electrostatographic element, contacting the resulting image with the toner composition of claim 1 to produce a toned image followed by transferring the toned image to a suitable substrate and permanently affixing the image thereto.

* * * * *